United States Patent [19]

Lu et al.

[11] 4,410,617

[45] Oct. 18, 1983

[54] COLORED TONER AND DEVELOPER COMPOSITION

[75] Inventors: Chin H. Lu, Webster; Christopher J. AuClair, Fairport, both of N.Y.

[73] Assignee: Xerox Corporation, Stamford, Conn.

[21] Appl. No.: 367,192

[22] Filed: Apr. 12, 1982

[51] Int. Cl.[3] ..... G03G 9/10

[52] U.S. Cl. ..... 430/106

[58] Field of Search ..... 430/106

[56] References Cited

U.S. PATENT DOCUMENTS

| | | | |
|---|---|---|---|
| 3,345,293 | 10/1967 | Bartoszewicz et al. | 430/106 |
| 3,609,082 | 9/1971 | Moriconi et al. . | |
| 3,884,825 | 5/1975 | Lindblad et al. . | |
| 3,893,935 | 7/1975 | Jadwin et al. . | |
| 3,933,664 | 1/1976 | Nagashima et al. | 430/106 |
| 4,066,563 | 1/1978 | Mammino et al. . | |
| 4,073,739 | 2/1978 | Peters . | |
| 4,298,672 | 11/1981 | Lu | 430/108 |

FOREIGN PATENT DOCUMENTS

| | | |
|---|---|---|
| 43-7596 | 3/1968 | Japan . |
| 49-5637 | 1/1974 | Japan . |
| 7415712 | 3/1975 | Netherlands . |

*Primary Examiner*—Roland E. Martin, Jr.

*Attorney, Agent, or Firm*—E. O. Palazzo

[57] ABSTRACT

This invention is generally directed to toner compositions, and developer compositions containing same, the toner compositions being comprised of resin particles, and pigment particles, wherein one of the pigments is comprised of an alkaline earth salt of 4-amino-2-chlorotoluene-5-sulfonic acid coupled to 3-hydroxy-2-naphthalene carboxylic acid of the formula

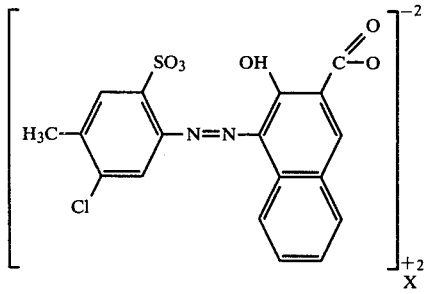

which compositions are useful in electrostatographic color imaging systems. In the above formula, X is the cation calcium, barium or strontium.

19 Claims, No Drawings

COLORED TONER AND DEVELOPER COMPOSITION

BACKGROUND OF THE INVENTION

The present invention is directed to toner compositions, and developer materials containing such compositions. More specifically, the present invention is directed to red toner compositions containing as a pigment, certain alkaline earth salts of sulfonic acids as described hereinafter. These salts when incorporated into the toner resin, either alone, or in combination with other pigments result in color developer compositions useful in a number of imaging systems, including electrostatographic imaging systems. Additionally, the toner and developer compositions of the present invention may contain additives such as charge enhancing additives, and such compositions can be utilized to develop negative electrostatic latent images, or positive electrostatic latent images.

Colored developing compositions comprised of resin particles, carrier particles, and pigments consisting of magenta, cyan and/or yellow materials are well known, for example, reference U.S. Pat. No. 4,066,563. There is disclosed in this patent color developing compositions containing certain specific cyan, magenta and yellow pigments, which developer compositions when employed together with specific carrier materials were found to be highly useful in developing color images. The intensity of the color desired is dependent not only on the concentrations of the pigments employed, but on other factors including the carrier material utilized, and the specific composition of the pigment added to the toner resin. Thus, for example, certain types of yellow pigments when used with magenta and cyan pigment result in the production of colored images containing a certain yellow intensity, for example, the yellow might be classified as a light yellow as compared to a bright yellow. Similarly, when certain red pigments are employed in electrostatic imaging systems there can result images of a low or high red intensity, that is the red color can range from the light red or pink to a deep red in some instances.

Commercial acceptance of color is dependent on a number of considerations including the pleasing nature of the color to the final user. The hue and/or chroma of the final color may be satisfactory to one individual, and not satisfactory to another. In some instances, the hue or chroma of the color is not satisfactory to a substantial number of individuals resulting in rejection of the final developed copies and failure from a commercial standpoint of the imaging device utilizing such developer compositions. Accordingly, there continues to be a need for the development of improved pigments, and color developing compositions containing same.

Additionally, some of the prior art pigments are not compatible with the toner resins and/or carrier particles utilized, and in some instances the pigments are incompatible with other pigments employed in the developing composition. Furthermore, several prior art developer compositions containing cyan, magenta and yellow pigments possess unsatisfactory hue and chroma, are sensitive to relative humidity, have slow admix charging, and unsatisfactory triboelectric charge in some instances.

SUMMARY OF THE INVENTION

It is an object of the present invention to provide color developing compositions which overcome the above-noted disadvantages.

A further object of the present invention is the provision of color developing compositions which contain cyan, yellow and magenta pigments wherein the magenta pigment comprises salts of alkaline earth sulfonic acids.

Another object of the present invention is the provision of colored developing compositions which may be useful for developing negatively charged electrostatic latent images, or positively charged electrostatic latent images.

Yet another object of the present invention is to provide developer compositions which contain as the red pigment, alkaline earth salts of certain sulfonic acids, coupled to napthonic acid.

In yet another object of the present invention there is provided developer compositions comprised of resin particles, pigment particles, and carrier particles, wherein the pigment particles contain as the red pigment, certain alkaline earth salts of sulfonic acids, which developer compositions are useful in developing color images in electrostatographic imaging systems.

These and other objects of the present invention are accomplished by the provision of toner compositions comprised of resin particles, and pigment particles, wherein one of the pigments is comprised of the alkaline earth salts of 4-amino-2-chlorotoluene-5-sulfonic acid coupled to 3-hydroxy-2-naphthalene carboxylic acid, believed to be of the formula as illustrated hereinafter. Also embraced within the scope of the present invention are developer compositions comprised of resin particles, carrier particles, and pigment particles, wherein one of the pigments is an alkaline earth salt of a 4-amino-2-chlorotoluene-5-sulfonic acid coupled to 3-hydroxy-2-naphthalene carboxylic acid.

In one embodiment, the present invention is directed to toner compositions comprised of resin particles and pigment particles wherein the pigment is an alkaline earth salt of a 4-amino-2-chlorotoluene-5-sulfonic acid coupled to 3-hydroxy-2-naphthalene carboxylic acid. In another illustrative embodiment of the present invention, there is provided toner compositions, comprised of resin particles, and pigment particles comprised of cyan pigments, yellow pigments, and as the red pigment an alkaline earth salt of 4-amino-2-chlorotoluene-5-sulfonic acid coupled to 3-hydroxy-2-naphthalene carboxylic acid.

The red pigment alkaline earth salts of 4-amino-2-chlorotoluene-5-sulfonic acid coupled to 3-hydroxy-2-naphthalene carboxylic acid, are commercially available, and believed to be of the following formula:

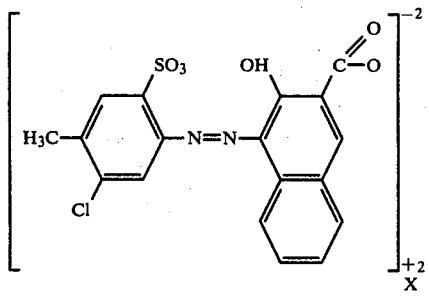

wherein X is the cation calcium, barium or strontium.

The barium salt is referred to commercially as Pigment Red 48:1 (C.I. 15865:1) while the calcium salt is known as Pigment Red 48:2 (C.I. 15865:) and the strontium salt is available as Pigment Red 48:3 (C.I. 15865:3). The barium and strontium salts are preferred primarily since they display certain specific colors.

The red alkaline earth metal salt pigments of the present invention can be incorporated into the toner composition in various amounts, providing the objectives of the present invention are accomplished. Generally, the amount of red alkaline earth metal salt present ranges from about 2 percent by weight, to about 20 percent by weight, and preferably from about 5 percent by weight to about 15 percent by weight based on the weight of the toner resin particles.

The alkaline earth metal salts of the present invention can be incorporated into the toner resin as the sole pigment, particularly in those situations wherein a specified red toner composition is desired. However, other pigments can be incorporated into the toner resin in addition to the red pigment, including, for example, various cyan and yellow pigments. Illustrative examples of cyan materials that may be used include copper tetra-4-(octadecyl sulfonomido)phthalocyanine, copper phthalocyanine pigment listed in the color index as CI-74160, CI Pigment Blue 15, a blue identified in the color index as CI-61890, Special Blue X-2137 and the like; while illustrative examples of yellow pigments that may be used include diarylide yellow 3,3-dichloro benzidene acetoacetanilide a monoazo dye identified in the color index as CI-12700, CI Solvent Yellow 16, a nitrophenyl amine sulfonamide identified in the color index as Foron yellow SEL/GLF, CI Dispersed Yellow 33, 2,5-dimethoxy-4-sulfonanilide phenyl azo-4-chloro-2,5-dimethoxy acetoacetanilide, permanent Yellow FGL, and the like. The percentage of these pigments that can be employed can vary depending upon many factors including the color shade of toner desired. Generally, however, from about 2 percent to about 20 percent by weight and preferably from about 5 percent to about 15 percent by weight of cyan, and yellow pigment are present in the toner composition.

Numerous methods may be employed to produce the toner composition of the present invention including, for example, melt blending the resin particles and the pigment particles together followed by mechanical attrition. Other methods include those well known in the art such as spray drying, melt dispersion, and dispersion polymerization. For example, in dispersion polymerization, a solvent dispersion of the resin particles and pigment particles are sprayed under controlled conditions resulting in the desired toner composition.

A variety of numerous suitable resin particles may be utilized in the toner composition of the present invention, typical of such resins including for example, polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorosytrene vinyl napthalene, ethylenically unsaturated monoolefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally, toner resins containing a relatively high percentage of styrene are preferred since greater image definition and density is obtained with their use. The styrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more resins if desired, preferably other vinyl resins which insure good triboelectric properties and uniform resistance against physical degradation. However, non-vinyl type thermoplastic resins may also be employed including resin modified phenolformaldehyde resins, oil modified epoxy resins, polyurethanes resins, cellulosic resins, polyether resins and mixtures thereof.

Additionally, there can be selected as the toner resins esterification products of a dicarboxylic acid and a diol such as those described for example in U.S. Pat. No. 3,655,374 the disclosure of which is totally incorporated by reference, the diphenol reactant being of the formula as shown in Column 4, beginning at line 5 of this patent, and the dicarboxylic acid component being of the formula as illustrated in Column 6, of this patent.

As part of the developer compositions there is included therein carrier particles which are selected in order that the toner particles will adhere to and surround the carrier particles. Illustrative examples of carrier particles that may be employed include those well known in the art such as steel, nickel, iron ferrites, silicone dioxide, glass, and the like. Additionally, the carrier particles may be coated with suitable coatings also known in the art such as fluoropolymers like polyvinylidene fluoride, methylterpolymers, terpolymers of styrene, methyl methacrylate, and siloxanes, ethyl cellulose, and the like. Further, nickel berry materials as described in U.S. Pat. Nos. 3,847,604 and 3,767,598 can be selected for use as the carrier particles, these particles being nodular beads of nickel characterized by a surface of reoccurring recesses and protrusions, thus providing particles with a relatively large external area. The diameter of the coated carrier particles is from about 50 to about 1,000 microns, thus allowing the carrier particles to possess sufficient density and inertia to avoid adherance to the electrostatic images during development process.

The toner and developer compositions of the present invention can additionally have incorporated therein various suitable charge enhancing additives, including quaternary ammonium compounds, nitrogen containing compounds such as nigrosines, organic sulfonate materials, like stearyl dimethyl phenethyl ammonium paratoluene sulfonate, alkyl pyridinium halides, such as cetyl pyridinium chloride and the like. The purpose of the charge enhancing additive is to impart a positive charge to the toner resin particles. Accordingly, developing compositions containing charge enhancing additives can be used, for example, to obtain color images.

Generally, the charge enhancing additive is present in an amount of form about 0.05 weight percent to about 10 weight percent and preferably from about 0.1 weight percent to about 5 weight percent of the total toner weight.

Also included within the scope of the present invention are electrostatographic color imaging methods wherein a latent electrostatic image is formed on an image bearing member, followed by developing the image with the toner and developer particles of the present invention, subsequently transferring the image to a suitable substrate and permanently affixing the image thereto. In one important embodiment of the present invention, colored images are obtained in a single pass color xerographic imaging method as disclosed in U.S. Pat. No. 4,312,932, the disclosure of which is totally incorporated herein by reference.

Illustrative examples of image bearing members that may be utilized in the imaging process of the present invention include conventional inorganic photoconductive materials such as amorphous selenium, alloys of selenium, including selenium arsenic alloys, selenium tellurium alloys, selenium antimony arsenic alloys, halogen doped selenium substances, and halogen doped selenium alloys, wherein the halogen is present in an amount of from about 50 parts per million to about 1,000 parts per million With regard to the positive imaging mode, that is when the developing compositions of the present invention are used to develop color electrostatic images charged positively, there can be utilized organic photoresponsive devices, including layered organic photoresponsive devices. Examples of layered organic photoresponsive devices include those comprised of a substrate, a generating layer, and a transport layer such as those disclosed in U.S. Pat. No. 4,265,990, the disclosure of which is totally incorporated herein by reference. Illustrative examples of generating layers that may be utilized include trigonal selenium and vanadyl phthalocyanine, while examples of transport layers include various diamines dispersed in resin binders reference U.S. Pat. No. 4,265,990.

Other organic photoresponsive devices useful in the present invention include materials such as polyvinylcarbazole, 4-dimethylaminobenzylidene, benzhydrazide; 2-benzylidene-amino-carbazole, 4-dimethylamino-benzylidene,(2-nitro-benzylidene)-p-bromoaniline; 2,4-diphenyl-quinazoline; 12,4,-triazine; 1,5-diphenyl-3-methyl pyrazoline 2-(4'dimethyl-amino phenyl)-benzoxazole; 3-amino-carbazole; polyvinylcarbazole-tritrofluorenone charge transfer complex; phthalocyanines and mixtures thereof.

The following examples are being supplied to further define specific embodiments of the present invention, it being noted that these examples are intended to illustrate, and not limit the scope of the present invention. Parts and percentages are by weight unless otherwise indicated.

EXAMPLE I

There was prepared toner composition A by melt blending followed by mechanical attrition, which toner composition contained 10 percent by weight of the Red Pigment Lithol Scarlet Red 48:1, C.I. 15865:1, the barrium salt of 4-amino-2-chlorotoluene-5-sulfonic acid coupled to 3-hydroxy-2-naphthalene carboxylic acid, available from BASF Corporation, Holland, Mich., and 90 percent by weight of a styrene n-butyl methacrylate copolymer resin, wherein the styrene is present in an amount of 58 percent by weight, and the n-butyl methacrylate is present in an amount of 42 percent by weight (58/42). The resulting toner composition was classified further so as to remove any particles below 5 microns in diameter.

Two parts per weight of this toner composition and 100 parts by weight of a ferrite carrier coated with 0.5 weight percent of a terpolymer of styrene, methyl methacrylate, and siloxane, reference U.S. Pat. No. 3,526,533, were placed in a glass jar and roll milled at a linear speed of 90 feet per minute for the time indicated in the following table. The triboelectric charge on the toner composition was then measured by blowing off the toner from the carrier in a Faraday cage.

| Time | Toner Tribo Microcoulombs per gram (uc/g) |
|---|---|
| 10 min | −12 |
| 1 hour | −17 |
| 3 hours | −18 |
| 5 hours | −18 |

This developer composition was then utilized in a xerographic imaging system employing a positively charged arsenic selenium photoreceptor, where the percentage by weight of selenium is 99.5 percent, and the percentage by weight of arsenic is 0.5 percent. High quality red prints of excellent resolution were obtained.

EXAMPLE II

There was prepared toner composition B by melt blending followed by mechanical attrition, which composition contains 6 percent by weight of the Lithol Scarlet Pigment Red 48:1, C.I. 15865:1, of Example I, 94 percent by weight of a styrene/n-butyl methacrylate copolymer resin, containing 58 percent by weight of styrene and 42 percent by weight of n-butyl methacrylate. The toner composition was then further classified to remove any particles below 5 microns.

The toner composition was then mixed with the carrier material of Example I in the same proportions, and the triboelectric charge contained on the toner particles was measured utilizing the Faraday cage process of Example I with the following results:

| Time | Toner Tribo Microcoulombs per gram (uc/g) |
|---|---|
| 10 minutes | −7 |
| 1 hour | −12 |
| 3 hours | −11 |
| 5 hours | −12 |

Substantially similar imaging results were obtained when the developer composition of this Example was employed to develop electrostatic latent images in accordance with Example I.

EXAMPLE III

A developer composition was prepared by melt blending followed by mechanical attrition, which composition contains the Lithol Scarlet Pigment Red 48:1, C.I. 15865:1, of Example I, the resin of Example I and a ferrite carrier coated with 0.35 weight percent of ethyl cellulose, T-50 available from Hercules Corporation. The triboelectric charge contained on the toner particles was measured in accordance with Example I with the following results:

| Time | Toner Tribo Microcoulombs per gram (uc/g) |
|---|---|
| 10 minutes | −33 |
| 1 hour | −29 |
| 3 hours | −25 |
| 5 hours | −25 |

The developer composition of this Example was utilized to develop electrostatic latent images in accordance with Example I and substantially similar results were obtained. There was thus obtained excellent quality red images with high solid area, and low background density.

EXAMPLE IV

There was prepared toner composition C by melt blending followed by mechanical attrition, containing 9.6 weight percent of the Lithol Scarlet Red Pigment of Example I, 0.4 percent of the magenta pigment 2,9-dimethyl substituted quinacridone, and 90 percent by weight of a styrene/n-butyl methacrylate copolymer resin containing 58 percent by weight of styrene and 42 percent by weight of n-butyl methacrylate. The toner composition was then classified to remove particles below 5 microns in diameter.

The triboelectric charge on the toner particles was measured in accordance with the procedure of Example I with the following results:

| Time | Toner Tribo Microcoulombs per gram (uc/g) |
|---|---|
| 10 minutes | −12 |
| 1 hour | −15 |
| 3 hours | −16 |
| 5 hours | −17 |

The developer composition of this example was utilized to develop latent electrostatic images in accordance with the procedure of Example I and substantially similar results were obtained. The color of the resulting image was substantially equivalent to Letraset Pantane Red 032 color.

EXAMPLE V

There was prepared toner composition D, by melt blending followed by mechanical attrition, which toner composition contained 10 percent by weight of Lithol Scarlet Pigment Red 48:2, C.I. 15865:2, the calcium salt of 4-amino-2-chlorotoluene-5-sulfonic acid coupled to 3-hydroxy-2-naphthalene carboxylic acid, available from BASF Corporation, Holland, Mich., and 90 percent by weight of a styrene/n-butyl methacrylate copolymer resin, containing 58 percent by weight of styrene and 42 percent by weight of n-butyl methacrylate. The toner composition prepared was classified to remove particles below 5 microns.

The triboelectric charge contained on the toner particles was then determined utilizing the carrier composition of Example I, and in accordance with the procedure described in Example I with the following results:

| Time | Toner Tribo Microcoulombs per gram |
|---|---|
| 10 minutes | −11 |
| 1 hour | −15 |
| 3 hours | −18 |
| 5 hours | −19 |

The developer composition of this example was utilized to develop latent electrostatic images in accordance with Example I and substantially similar results were obtained. The color of the resulting image as determined by visual observation was a deep bluish bright red.

EXAMPLE VI

There was prepared toner composition E, by melt blending followed by mechanical attrition, which composition contained 10 percent by weight of Lithol Scarlet Pigment Red 48:3, C.I. 15865:3, the strontium salt of 4-amino-2-chlorotoluene-5-sulfonic acid coupled to 3-hydroxy-2-naphthalene carboxylic acid, available from BASF Corporation, Holland, Mich., and 90 percent by weight of a styrene/n-butyl methacrylate copolymer resin containing 58 percent by weight of styrene and 42 percent by weight of n-butyl methacrylate. The toner composition was then further classified to remove particles below 5 microns.

The triboelectric charge on the toner composition was determined in accordance with the procedure described in Example I, and utilizing the same carrier composition, with the following results:

| Time | Toner Tribo Microcoulombs per gram (uc/g) |
|---|---|
| 10 minutes | −11 |
| 1 hour | −14 |
| 3 hours | −16 |
| 5 hours | −16 |

The above developer composition was utilized to develop images in a xerographic imaging device in accordance with Example I and substantially similar results were obtained. The color of the resulting image as determined by visual observation was a bright bluish red.

EXAMPLE VII

There was prepared toner composition F, by melt blending followed by mechanical attrition, which composition contains 6.67 percent by weight of Lithol Scarlet Pigment Red 48:1, C.I. 15865:1, as described in Example I and 3.33 percent by weight of Lithol Scarlet Pigment Red 48:3, C.I. 15865:3, as described in Example VI, 3 percent of ortho-phthalic acid as a charge control additive, and 87 percent of the styrene/n-butyl methacrylate copolymer resin described in Example I. The copolymer resin was classified to remove particles below 5 microns.

The triboelectric charge on the toner particles was measured in accordance with Example I, and the following results were obtained:

| Time | Toner Tribo Microcoulombs per gram (uc/g) |
|---|---|
| 10 minutes | −21 |
| 1 hour | −17 |
| 3 hours | −16 |
| 5 hours | −15 |

The above developer composition was utilized to develop images in a xerographic imaging device in accordance with Example I, and substantially similar results were obtained.

The color of the resulting image was substantially equal to Letrase Pantone Red 032 color.

By developer compositions is meant a mixture comprised of resin particles, pigment particles, such as the red pigment of the present invention, carrier particles, and as an optional ingredient, a charge enhancing additive. Thus, the developer composition of Example I contains two parts by weight of the toner composition indicated, and 100 parts by weight of coated ferrite carrier particles.

Other modifications of the present invention will occur to those skilled in the art based upon a reading of the present disclosure, and these are intended to be included within the scope of the present invention, thus other pigments may be added to the developer composition of the present invention, including the magenta pigments recited in U.S. Pat. No. 4,312,912, the disclosure of which is totally incorporated herein by reference. Also, charge enhancing additives in addition to those disclosed may be incorporated into the developer composition of the present invention, including, for example, various phthalic acids.

We claim:

1. An improved developer composition comprised of carrier particles, resin particles, and dispersed in the resin particles pigment particles, wherein one of the pigments is comprised of the alkaline earth salts of 4-amino-2-chlorotoluene-5-sulfonic acid coupled to 3-hydroxy-2-napthalene carboxylic acid of the formula

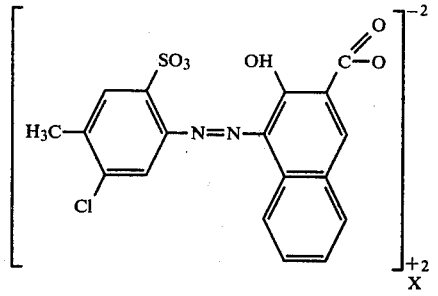

wherein X is the cation calcium, barium or strontium.

2. An improved developer composition in accordance with claim 1 wherein the alkaline earth salt is barium.

3. An improved developer composition in accordance with claim 1 wherein the alkaline earth salt is calcium.

4. An improved developer composition in accordance with claim 1 wherein the alkaline earth salt is strontium.

5. An improved developer composition in accordance with claim 1 wherein the alkaline earth salt is present in an amount of from about 0.5 percent to about 10 percent, based on the weight of the toner particles.

6. An improved developer composition in accordance with claim 1 wherein the resin particles are comprised of a styrene/n-butyl methacrylate resin.

7. An improved developer composition in accordance with claim 1 wherein the pigment particles include cyan compositions, magenta compositions, and yellow compositions.

8. An improved developer composition in accordance with claim 1 wherein the carrier particles are comprised of steel, coated with a terpolymer resin.

9. An improved developer composition in accordance with claim 1 wherein the carrier particles are comprised of steel coated with ethyl cellulose.

10. An improved developer composition in accordance with claim 1 wherein the carrier particles are comprised of steel coated with a polyvinylidene fluoride resin.

11. An improved developer composition in accordance with claim 1 wherein the carrier particles are comprised of iron ferrites coated with a terpolymer resin.

12. An improved developer composition in accordance with claim 1 wherein the carrier particles are comprised of iron ferrites coated with a polyvinylidene fluoride.

13. An improved developer composition in accordance with claim 1 further including therein charge enhancing additives for the purpose of imparting a positive charge to the toner resin particles.

14. A toner composition in accordance with claim 13 wherein the charge enhancing additive is an alkyl pyridinium halide.

15. A toner composition in accordance with claim 14 wherein the alkyl pyridinium halide is cetyl pyridinium chloride.

16. A method for developing electrostatographic images which comprises forming an electrostatic latent image on an image bearing member, followed by developing the image with the toner composition of claim 1, subsequently transferring the image to a permanent substrate, and permanently affixing the image thereon.

17. A method of imaging in accordance with claim 16 wherein the imaging member is comprised of amorphous selenium or halogen doped amorphous selenium.

18. A method of imaging in accordance with claim 16 wherein the imaging member is comprised of a selenium alloy, or a halogen doped selenium alloy.

19. A method of imaging in accordance with claim 18 wherein the imaging member is an arsenic selenium alloy or a selenium tellurium alloy.

* * * * *